US005633666A

United States Patent [19]

Haigo

[11] Patent Number: 5,633,666

[45] Date of Patent: May 27, 1997

[54] INK SUPPLY DEVICE

[75] Inventor: Hideaki Haigo, Nagoya, Japan

[73] Assignee: Brother Kogyo Kabushiki Kaisha, Nagoya, Japan

[21] Appl. No.: 237,054

[22] Filed: May 3, 1994

[30] Foreign Application Priority Data

Jun. 18, 1993 [JP] Japan ..... 5-147475

[51] Int. Cl.[6] ..... B41J 2/175

[52] U.S. Cl. ..... 347/86

[58] Field of Search ..... 347/86, 87

[56] References Cited

U.S. PATENT DOCUMENTS

| | | | |
|---|---|---|---|
| 4,095,237 | 6/1978 | Amberntsson et al. . | |
| 4,368,478 | 1/1983 | Koto | 347/86 |
| 4,771,295 | 9/1988 | Baker et al. . | |
| 4,931,811 | 6/1990 | Cowger et al. | 347/87 |
| 5,025,271 | 6/1991 | Baker et al. . | |
| 5,155,502 | 10/1992 | Kimura et al. . | |
| 5,156,472 | 10/1992 | Suzuki et al. | 347/86 |
| 5,182,579 | 1/1993 | Haruta et al. | 347/87 |

FOREIGN PATENT DOCUMENTS

| | | | |
|---|---|---|---|
| 88292 | 9/1983 | European Pat. Off. | 347/87 |
| 585615 | 9/1995 | European Pat. Off. | 347/86 |

*Primary Examiner*—John E. Barlow, Jr.
*Attorney, Agent, or Firm*—Oliff & Berridge

[57] ABSTRACT

An ink supply port to supply ink to a print head is formed on an ink tank, and a filter is provided along the inside surface of the ink tank with an ink foam member arranged therein. The ink foam member has a convex shaped portion where it confronts the filter. Thus, in operation, the convex portion is compressed and firmly contacts with the filter with a uniform pressure. The ink absorbed in the foam member is moved by capillary action from an uncompressed portion to a dense compressed portion of the foam member, which is the convex portion. Then, the ink absorbed in the foam member is transferred into a ink room provided in the ink tank by the capillary action of the filter. The ink is then supplied to the ink jet head through a hollow needle inserted into the ink room.

22 Claims, 3 Drawing Sheets

INK SUPPLY DEVICE

BACKGROUND OF THE INVENTION

1. Field of the Invention

The present invention relates to an ink supply device for supplying ink to a print head.

2. Description of Related Art

A conventional ink supply device is disclosed in U.S. Pat. No. 4,771.295, which is explained below.

As shown in FIG. 5, an ink absorbing member 32 is arranged inside an ink tank 31 and is made of a porous material or fibers. A supply port 34 for supplying an ink absorbed in the ink absorbing member 32 to an ink jet head 35 is arranged inside the ink tank 31. A filter 33 is mounted on the supply port 34. Moreover, the supply port 34 projects into the ink tank 31. Therefore, the ink absorbing member 32 and the filter 33 firmly contact, and the ink absorbing member 32 adjacent to the filter 33 is compressed. As a result, uniform pressure is applied to the whole filter 33 by the compressed ink absorbing member 32. Thereby, ink in the ink absorbing member 32 flows toward the compressed portion, adjacent to the supply port 34, by capillary action. Moreover, the ink absorbing member 32 firmly contacts with the filter 33 to prevent air bubbles from passing from the ink tank 31 to the ink jet head 35.

However, in the conventional ink supply device, the supply port 34 projects into the ink tank 31. Therefore, the ink in the portion of the ink tank 31 that is lower than the supply port 34 cannot be supplied easily to the ink jet head 35, and the ink cannot be effectively used. Moreover, the construction of the device is complex and the manufacturing cost of the device is high because the supply port projects into the ink tank 31.

SUMMARY OF THE INVENTION

It is an object of the present invention to provide an ink supply device wherein ink can be effectively used and to provide a low-cost ink supply device.

To achieve the above mentioned and other objects, an ink supply device of the present invention comprises an ink tank, an ink absorbing member arranged inside the ink tank made of a porous material, and a supply port provided on the ink tank for supplying ink absorbed in the ink absorbing member to a print head, wherein a portion of the ink absorbing member confronting the supply port has a projected shape when the ink absorbing member is not arranged inside the ink tank.

Further, the ink supply device of the present invention comprises a filter that is provided on the supply port, and the projected portion of the ink absorbing member provides a uniform pressure to the filter.

Moreover, in the ink supply device of the present invention, the supply port is provided along an inside wall of the ink tank.

In the ink supply device of the present invention thus constructed, the ink absorbing member has a projected portion where it is to confront with the supply port when the ink absorbing member is arranged inside the ink tank. The projected portion of the ink absorbing member is compressed by the supply port and firmly contacts with the supply port when the ink absorbing member is arranged inside the ink tank.

According to the ink supply device of the present invention, the ink absorbing member having a portion shaped to confront a projecting supply port can be compressed and firmly contacted with the supply port. So, all of the ink absorbed in the ink absorbing member can be supplied to the print head.

Moreover, the construction of the ink tank is very simple, so that the ink supply device can be manufactured easily and with low-cost.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

A preferred embodiment that embodies the present invention is explained with reference to the accompanying drawings.

Figure 1:
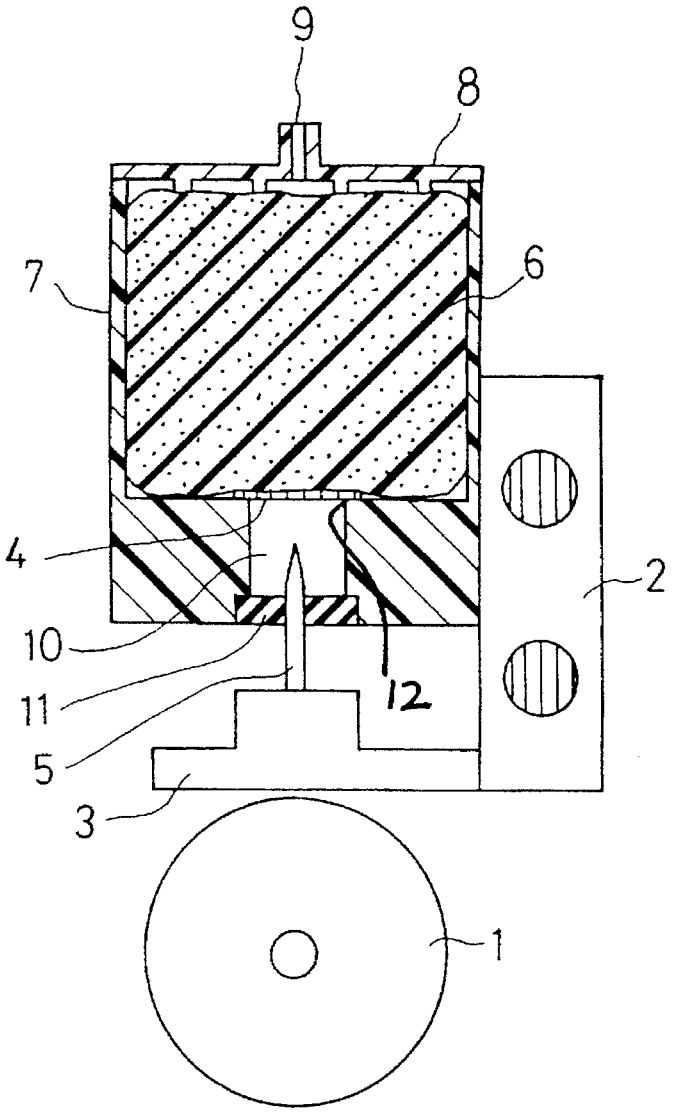
FIG. 1 is a view in partial cross-section showing an ink supply device in a preferred embodiment of the present invention.
Figure 2:
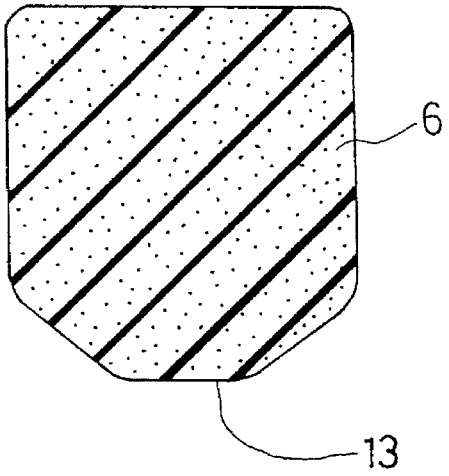
FIG. 2 is a cross-sectional view showing a foam member to be arranged in the ink supply device of the preferred embodiment of the present invention as shown in FIG. 1.

As shown in FIG. 1, a carriage 2 reciprocatably moves along a platen 1, and an ink jet head 3 commonly referred to as a print head, is mounted adjacent to the platen 1. An ink tank 7 is detachably mounted on the carriage 2 on an upper side of the ink jet head 3. A hollow needle 5 extends from the ink jet head 3 and interconnects between the ink jet head 3 and the ink tank 7. Inside the ink tank 7, a foam member 6 made of a porous material or fibers such as polyurethane foam is arranged with ink absorbed therein. The foam member 6 has a convex projecting portion 13, as shown in FIG. 2.

An atmospheric air communication hole 9 is arranged on a cover 8 of the ink tank 7 for interconnecting the inside of the ink tank 7 and the atmospheric air. The atmospheric air is supplied to the foam member 6 therethrough. The ink absorbed in the foam member 6 is pushed by the air and is therefore smoothly supplied to the ink jet head 3. Moreover, a supply port 12 is formed in a bottom of the ink tank 7 for supplying ink to the ink jet head 3. A filter 4 is provided over the supply port 12 along the bottom surface of the ink tank 7. The filter 4 consists of a plurality of minute communication holes. Therefore, only the ink absorbed in the foam member 6 can pass through the filter 4 by the capillary action of the filter 4, and air contained in the foam member 6 does not pass through the filter 4.

Figure 3:
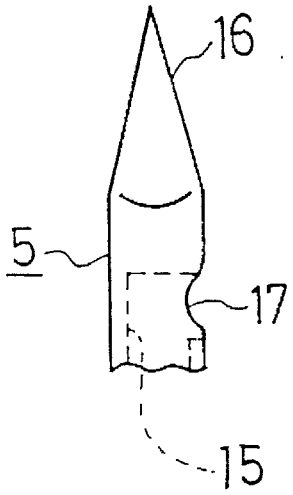
FIG. 3 is a partial side view showing a hollow needle to be used in the ink supply device of the preferred embodiment of the present invention as shown in FIG. 1.

An ink room 10 adjacent to the filter 4 stores ink that has passed through the filter 4 and oozed from the foam 6. The end portion of the ink room 10 is sealed by a stopper 11 that consists of an elastic member such as rubber. The ink in the ink tank 7 is supplied to the ink jet head 3 through the hollow needle 5 inserted into the stopper 11. The ink room 10 is kept in an airtight condition due to the stopper 11 and the filter 4. The hollow needle 5 is constructed from a hollow tube portion 15 and a conical tip or edge portion 16 as shown in Fig. 3. An ink introduction entrance 17 is installed in a side wall of the hollow tube portion 15. The edge portion 16 has a conic shape in order to be easily pressed into the stopper 11 with little power.

Figure 4:
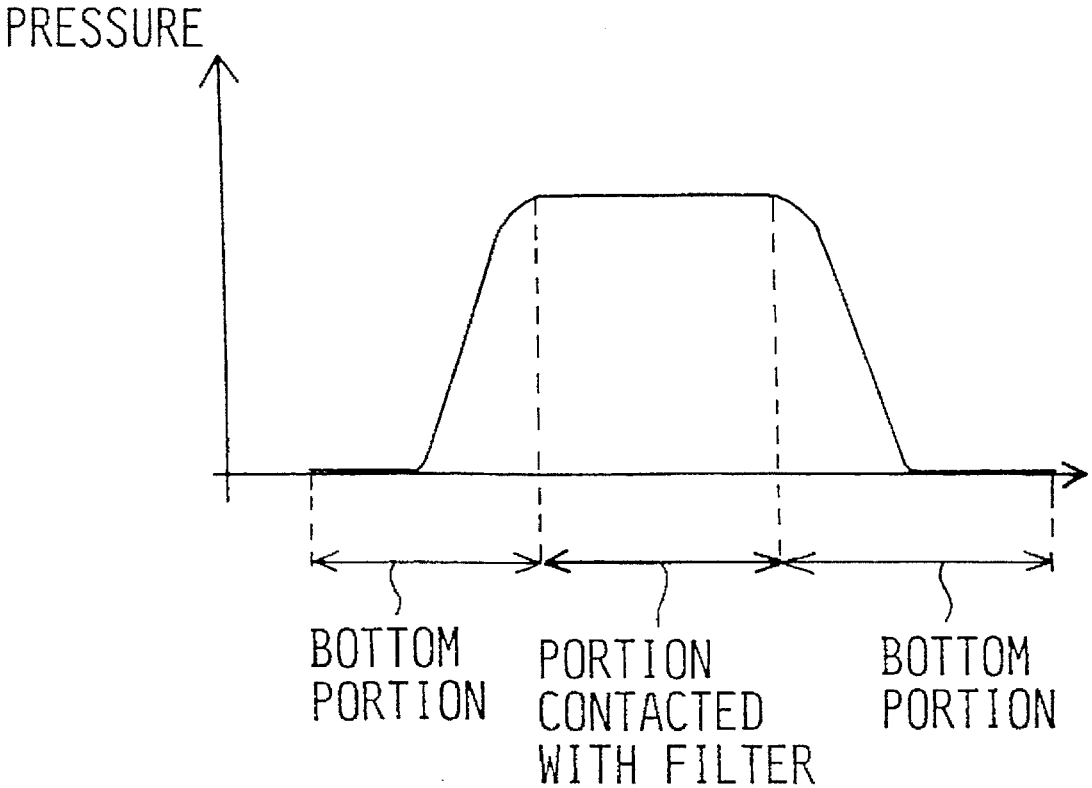
FIG. 4 is a graph showing a pressure distribution in each position of the foam member in the preferred embodiment of the present invention as shown in FIG. 1.
Figure 5:
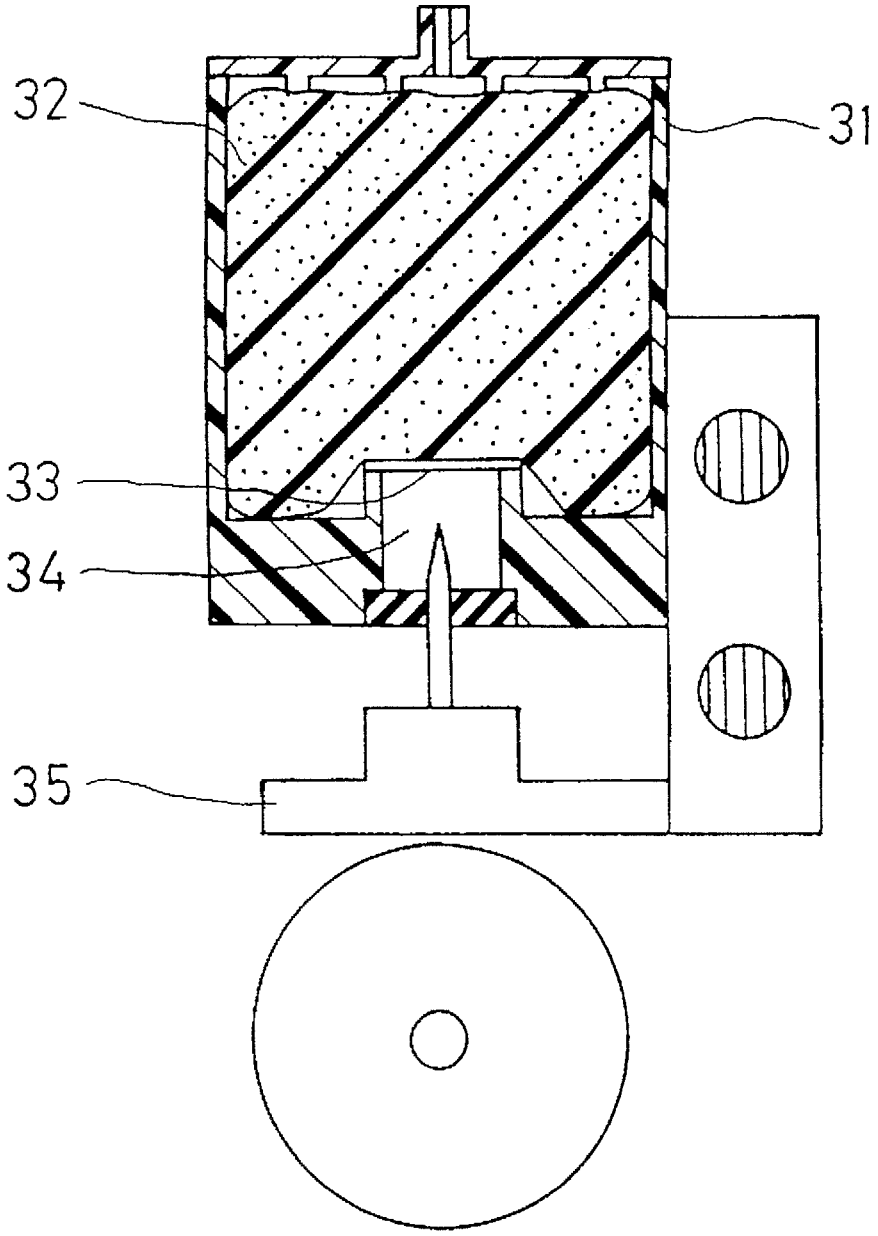
Fig.5 PRIOR ART
FIG. 5 is a cross-sectional view showing a conventional ink supply device.

Next, an ink filling method is explained. First, the cover 8 of the ink tank 7 is opened, and the foam member 6 is arranged in the ink tank 7 with the convex portion 13 positioned downwardly. Then, the cover 8 is shut. As the foam member 6 has a convex shape at the portion where it confronts the filter 4, the convex portion 13 is compressed and firmly contacts the filter 4 as shown in FIG. 1. At this time, uniform pressure is applied to the filter 4 as shown in FIG. 4. Then, an ink is poured into the ink tank 7 though an ink inlet (not shown), and the foam member 6 is filled with the ink. By capillary action, the ink moves from an uncompressed portion to a dense compressed portion of the foam member 6, which is the convex portion 13 that is compressed and firmly contacted with the filter 4. Then, the ink absorbed in the foam member 6 passes into the ink room 10 by the capillary action of the filter 4. At the time of initially setting the foam member 6, the ink in the ink room 10 is sucked by an ink suction device (not shown) and supplied to the ink jet head 3 through the hollow needle 5 to prime the apparatus.

Finally, the ink jet head 3 ejects the ink and prints an image according to a desired print data. Then, negative pressure is generated in ink jet head 3 by the ink ejection, and the ink is further drawn from the ink room 10 to the ink jet 3 through the hollow needle 5. When the ink in the ink room 10 decreases, the ink absorbed in the foam member 6 is replenished to the ink room 10 by the capillary action of the filter 4. Since the convex portion 13 of the foam member 6 is compressed in the vicinity of the filter 4, the ink absorbed in the foam member 6 moves to the compressed portion by capillary action.

As mentioned above, the foam member 6 is compressed in the vicinity of the filter 4 and contacts with the filter 4 with uniform pressure because the foam member 6 has a convex shape confronting the filter 4 (that is, the ink supply port 12). So, the ink absorbed in the foam member 6 is moved to the filter 4 and can be smoothly supplied to ink jet head 3 without supplying air contained in the foam member 6 to the ink jet head 3. Moreover, the filter 4 is provided along the bottom surface of the ink tank 7, so that all of the ink absorbed in the foam member 6 arranged in the ink tank 7 can be effectively used. In addition, the construction of the ink tank 7 is simpler than the conventional device, so that the manufacturing cost decreases compared to the conventional device.

It is to be understood that the present invention is not restricted to the particular forms shown in the foregoing embodiment, and various modifications and alterations can be added thereto without departing from the scope of the inventions encompassed by the appended claims.

For example, the ink jet head 3 is shown as being arranged downwardly in the above embodiment, but it can be arranged sidewardly. Moreover, the ink tank 7 is detachably arranged on the carriage 2 in the above embodiment, but an ink tank to which a print head for jetting ink is integrally mounted can be also used. In addition, it is possible to arrange the ink tank 7 separately from the carriage 2.

Further, in the present embodiment, the shape of the bottom end of the convex portion 13 of the foam member 6 that firmly contacts with the filter 4 is flat as shown in FIG. 2. However, any shape other than flat can be accepted as long as the filter 4 and the foam member 6 firmly contact when the foam member 6 is compressed against the filter 4.

What is claimed is:

1. An ink supply device for supplying ink to a print head, said ink supply device comprising:

an ink tank comprising ink supply means for supplying ink to the print head including an ink supply port provided in an inside surface of the ink tank; and ink absorbing means for absorbing ink, said ink absorbing means being arranged in said ink tank, wherein said ink absorbing means includes a projecting portion that projects toward said ink supplying means prior to arranging said ink absorbing means in said ink tank, and said projecting portion directly abutting and being compressed against said ink supplying means when said absorbing means is arranged inside said ink tank thus creating an area in the ink absorbing means that is more dense than other areas of the ink absorbing means that directly abuts the ink supply port so that ink absorbed in said ink absorbing means is drawn to the compressed projecting portion by capillary action and is directly funneled to the ink supply port.

2. The ink supply device according to claim 1 further comprising filter means for filtering ink from said ink absorbing means provided on said ink supplying means, wherein said projecting portion of said ink absorbing means applies uniform pressure to said filter means.

3. The ink supply device according to claim 1, wherein said ink supply port is flush with the inside surface of said ink tank.

4. The ink supply device according to claim 1 wherein said ink supply port comprises an air-tight ink room and is sealed by a resilient stopper.

5. The ink supply device according to claim 1, wherein said ink absorbing means is made of a porous material.

6. The ink supply device according to claim 1, wherein said ink absorbing means is polyurethane foam.

7. The ink supply device according to claim 1 wherein said ink tank is detachably coupled to the print head.

8. The ink supply device according to claim 1 wherein said ink tank is integral with the print head.

9. The ink supply device according to claim 1 wherein said ink tank further comprises a cover, wherein said cover has an air hole therein.

10. The ink supply device according to claim 1 further comprising ink transfer means for transferring ink from said ink tank to the print head.

11. The ink supply device according to claim 10 wherein said ink transfer means comprises a hollow needle with an ink entrance sealingly engaged in said ink supply means.

12. The ink supply device according to claim 1, wherein a higher capillarity is developed in said ink absorbing means in an area of the projecting portion due to compression.

13. An ink supply device comprising:

an ink tank including an ink supply port adapted to communicate with a print head; and a foam member impregnated with ink and having a protruding compressible portion that projects toward the ink supply port, the foam member being disposed in the ink tank with the protruding portion being directly compressed against the supply port and forming a dense area in the foam member, said protruding compressible portion being formed as a convex portion at an extremity of the foam member, wherein ink impregnated in the foam member naturally travels to the compressed protruding portion by capillary action and collects in the dense area immediately adjacent to the supply port so as to be funneled to the supply port.

14. The ink supply device according to claim 13, further comprising a filter provided on the ink supply port, wherein the protruding portion of the foam member applies uniform pressure to the filter means.

15. The ink supply device according to claim 13, wherein the foam member is polyurethane foam.

16. The ink supply device according to claim 13, wherein the ink tank is detachably coupled to the print head.

17. The ink supply device according to claim 13, wherein the ink tank is integral with the print head.

18. The ink supply device according to claim 13, wherein the ink supply port comprises an air-tight ink room, the ink supply port being sealed by a resilient stopper.

19. The ink supply device according to claim 13, wherein the ink tank further comprises a cover, wherein the cover has an air hole therein.

20. The ink supply device according to claim 13 further comprising a hollow needle with an ink entrance sealingly engaged in the ink supply port.

21. The ink supply device according to claim 13, wherein the ink supply port is a passage formed flush with an interior surface of the ink tank.

22. The ink supply device according to claim 12, wherein a higher capillarity is developed in said foam member in an area of the projecting portion due to compression.

* * * * *